US008205978B2

(12) United States Patent
Shimizu

(10) Patent No.: US 8,205,978 B2
(45) Date of Patent: Jun. 26, 2012

(54) LIQUID EJECTING HEAD FOR EFFECTIVELY DISCHARGING AIR BUBBLES

(75) Inventor: Yoichiro Shimizu, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 366 days.

(21) Appl. No.: 12/536,020

(22) Filed: Aug. 5, 2009

(65) Prior Publication Data

US 2010/0073446 A1 Mar. 25, 2010

(30) Foreign Application Priority Data

Sep. 25, 2008 (JP) ..... 2008-245455

(51) Int. Cl.
*B41J 2/19* (2006.01)
*B41J 2/45* (2006.01)
*B41J 2/18* (2006.01)

(52) U.S. Cl. ..... 347/92; 347/71; 347/89

(58) Field of Classification Search ..... 347/71
See application file for complete search history.

(56) References Cited

U.S. PATENT DOCUMENTS

| | | | | |
|---|---|---|---|---|
| 7,241,000 | B2 | 7/2007 | Hirota et al. | |
| 2005/0146582 | A1 * | 7/2005 | Platt et al. | 347/87 |
| 2005/0157104 | A1 * | 7/2005 | Hirota et al. | 347/85 |
| 2006/0103700 | A1 | 5/2006 | Taira | |
| 2006/0181579 | A1 * | 8/2006 | Taira | 347/65 |
| 2006/0214997 | A1 | 9/2006 | Chikamoto | |
| 2007/0139463 | A1 * | 6/2007 | Chikamoto et al. | 347/29 |
| 2007/0139484 | A1 * | 6/2007 | Taira et al. | 347/68 |
| 2007/0139498 | A1 * | 6/2007 | Chikamoto et al. | 347/93 |
| 2007/0229602 | A1 | 10/2007 | Taira et al. | |

FOREIGN PATENT DOCUMENTS

| | | | |
|---|---|---|---|
| JP | 2005-169839 | A | 6/2005 |
| JP | 2006-168339 | A | 6/2006 |
| JP | 2006-264115 | A | 10/2006 |
| JP | 2007-268868 | A | 10/2007 |

OTHER PUBLICATIONS

Japan Patent Office; Notification of Reason for Refusal in Japanese Patent Application No. 2008-245455 (counterpart to the above-captioned US Patent Application) mailed on Jul. 20, 2010.

* cited by examiner

*Primary Examiner* — Shelby Fidler
(74) *Attorney, Agent, or Firm* — Baker Botts L.L.P.

(57) ABSTRACT

A head for ejecting a liquid from ejection holes, including: a first flow-passage member in which are formed (a) a liquid-supply passage, (b) branch passages connected to the liquid-supply passage, and (c) discharge passages each being connected to any of the branch passages; a second flow-passage member in which are formed (a) at least one common passage each communicating with at least one of the branch passages and (b) individual passages having respective pressure chambers, each individual passage being connected to any one of the at least one common passage and introducing the liquid to a corresponding one of the ejection holes via a corresponding one of the pressure chambers; a first filter disposed in the liquid-supply passage; second filters disposed between the branch passages and the at least one common passage: and at least one energy giving member for giving ejection energy to the liquid in each pressure chamber.

19 Claims, 10 Drawing Sheets

LIQUID EJECTING HEAD FOR EFFECTIVELY DISCHARGING AIR BUBBLES

CROSS REFERENCE TO RELATED APPLICATION

The present application claims priority from Japanese Patent Application No. 2008-245455, which was filed on Sep. 25, 2008, the disclosure of which is herein incorporated by reference in its entirety.

BACKGROUND OF THE INVENTION

1. Field of the Invention

The present invention relates in general to a liquid ejecting head for ejecting a liquid therefrom.

2. Description of the Related Art

The following Patent Document 1 discloses an ink-jet head including: a head main body which has an ink ejection surface formed in its lower surface; and a reservoir unit having substantially the same shape, in plan view, as the head main body and temporarily storing ink to be supplied to the head main body. In the disclosed ink-jet head, a filter is disposed in an upper reservoir which is the most upstream region in an ink flow passage formed in the reservoir unit. To the upper reservoir, a discharge passage is connected at a portion of the upper reservoir that is located on the downstream side of the filter. The discharge passage is branched from the upper reservoir and reaches a discharge port provided in the reservoir unit.

Air bubbles staying between the filter and a branch point at which the discharge passage is branched from the upper reservoir (i.e., a connecting point at which the discharge passage is connected to the upper reservoir) are forcibly discharged to an outside of the reservoir unit from the discharge port through the discharge passage, by conducting a pressure purging operation in which ink is supplied to the reservoir unit using a pump connected to an upstream end of the reservoir unit. The air bubbles are thus forcibly discharged, thereby obviating an occurrence of ejection failure and permitting the ink-jet head to recover from the ejection failure.

Patent Document 1: JP-A-2007-268868

SUMMARY OF THE INVENTION

In the ink-jet head disclosed in the above-indicated Patent Document 1, the flow passage connected to a downstream end of the upper reservoir is branched into two passages in each of which five outflow passages are formed. The outflow passages are connected to passages formed in the head main body. The above-described discharge passage is connected to the upper reservoir at the branch point indicated above that is located more upstream than the position which is located on the downstream side of the filter and at which the flow passage is branched into two passages. Accordingly, even though the pressure purging operation is conducted, the air bubbles that can be discharged through the discharge passage are limited to those staying between the filter and the branch point. Therefore, the air bubbles existing in the passages in the reservoir unit that extend from the branch point to the head main body, namely, the air bubbles existing in the substantial part of the passages in the reservoir unit, cannot be discharged through the discharge passage.

The ink-jet head disclosed in the Patent Document 1 indicated above may be modified to have another filter disposed at a boundary between the reservoir unit and the head main body and having a mesh size smaller than that of the filter disposed in the upper reservoir. In this instance, however, the air bubbles staying between the branch point and the head main body cannot be sufficiently discharged from the nozzles of the head main body by the purging operation in which the output level of the pump is set at a normal level because of a large pressure loss due to the two different kinds of filters. Accordingly, it is needed to set the output level of the pump at a higher level than usual. However, the increase in the output level of the pump involves an increase in the amount of ink to be discarded, causing a disadvantage to users.

A need has arisen for a liquid ejecting head capable of effectively discharging air bubbles while suppressing an amount of a liquid to be discarded in a purging operation where two different kinds of filters are disposed in the liquid ejecting head.

According to one embodiment herein, a liquid ejecting head for ejecting a liquid from a plurality of ejection holes may comprise: a first flow-passage member in which are formed (a) a liquid-supply passage to which the liquid is supplied from an exterior of the liquid ejecting head, (b) a plurality of branch passages connected to the liquid-supply passage, and (c) a plurality of discharge passages each of which is connected to any of the plurality of branch passages and each of which is in communication with an outside of the first flow-passage member;

a second flow-passage member in which are formed (a) at least one common liquid passage each of which is in communication with at least one of the plurality of branch passages and (b) a plurality of individual passages which are provided so as to respectively correspond to the plurality of ejection holes, each of which is connected to any one of the at least one common liquid passage, and which respectively have pressure chambers formed therein, each of the plurality of individual liquid passages introducing the liquid to a corresponding one of the plurality of ejection holes via a corresponding one of the pressure chambers; a first filter disposed in the liquid-supply passage; a plurality of second filters disposed between the plurality of branch passages and the at least one common liquid passage: and at least one energy giving member configured to give ejection energy to the liquid in each of the pressure chambers that are formed respectively in the plurality of individual liquid passages.

In the liquid ejecting head described above wherein the discharge passages are connected to any of the branch passages, the air bubbles staying in the first flow-passage member between the first and second filters, especially, the air bubbles staying between the first filter and inlets of the discharge passages, can be effectively discharged through the discharge passages while suppressing the amount of the liquid to be discarded upon purging in an instance where two different kinds of filters are used.

BRIEF DESCRIPTION OF THE DRAWINGS

The above and other objects, features, advantages and technical and industrial significance of the present invention will be better understood by reading the following detailed description of a preferred embodiment of the invention, when considered in connection with the accompanying drawings, in which.

DETAILED DESCRIPTION OF THE EMBODIMENT

Figure 1:
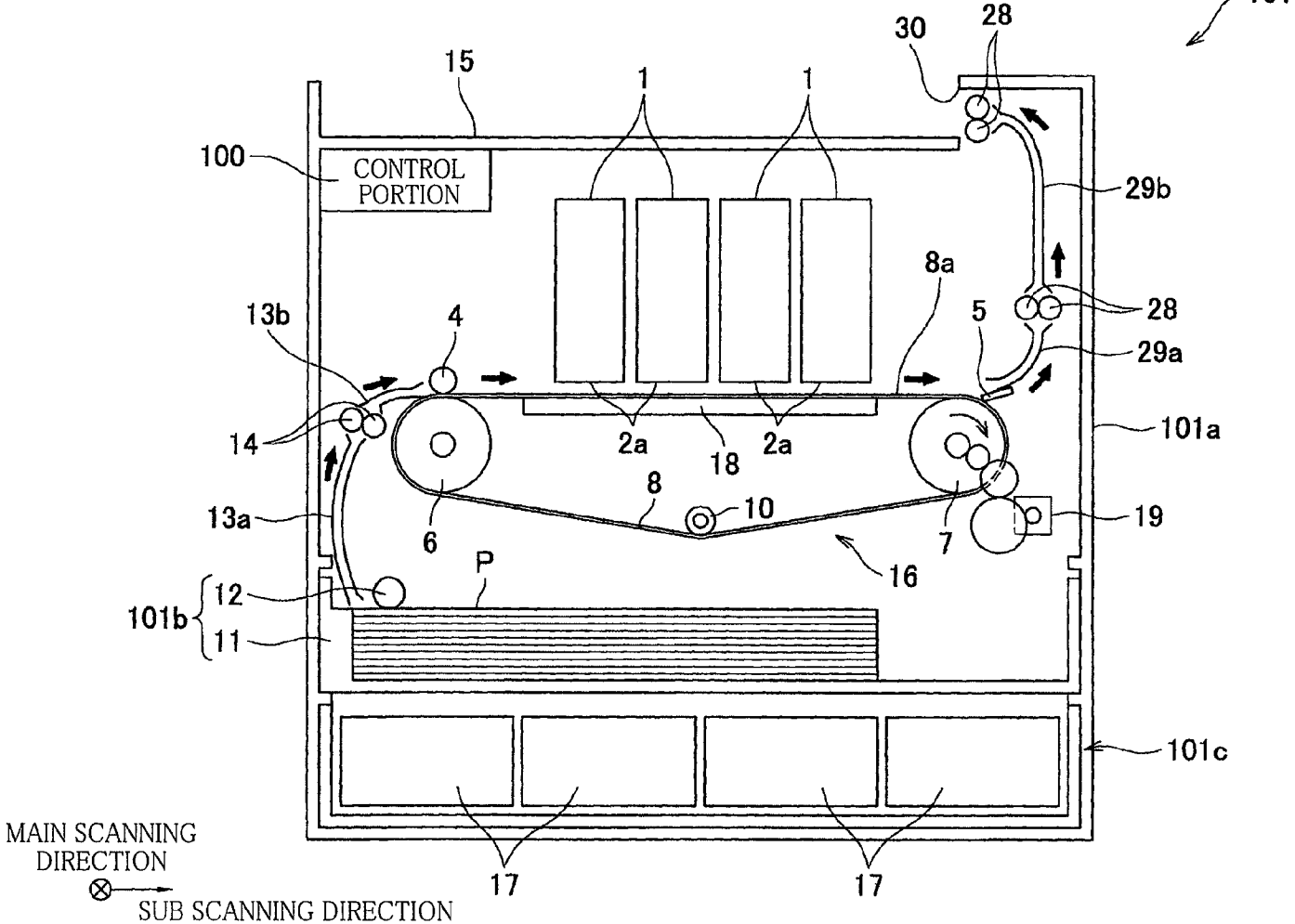
FIG. 1 is a vertical cross sectional view showing an internal structure of an ink-jet printer including an ink-jet head according to one embodiment of the invention.

Referring to the drawings, there will be explained an embodiment of the present invention.

FIG. 1 shows an internal structure of an ink-jet printer including an ink-jet head as a liquid ejecting head according to one embodiment of the invention. As shown in FIG. 1, the ink-jet printer generally indicated at 101 in FIG. 1 has a casing 101*a* having a rectangular parallelepiped shape. In the casing 101*a*, there are disposed: four ink-jet heads 1 which respectively eject magenta ink, cyan ink, yellow ink, and black ink; and a sheet conveying mechanism 16. On the inner surface of the top plate of the casing 101*a*, a control portion 100 for controlling operations of the ink-jet heads 1 and the sheet conveying mechanism 16 is attached. A sheet-supply unit 101*b* is disposed below the sheet conveying mechanism 16. The sheet-supply unit 101*b* is removably attached to the casing 101*a*. Below the sheet-supply unit 101*b*, an ink tank unit 101*c* is disposed so as to be detachable from the casing 101*a*.

In the ink-jet printer 101, there is formed a sheet delivery path through which a sheet P is delivered along solid arrows in FIG. 1 from the sheet-supply unit 101*b* toward a sheet receiving recessed portion 15. The sheet-supply unit 101*b* includes: a sheet tray 11 having a box-like shape opening upward and accommodating a stack of the sheets P; and a sheet-supply roller 12 configured to supply an uppermost one of the sheets P accommodated in the sheet tray 11. The sheet P supplied from the sheet tray 11 by the sheet-supply roller 12 is delivered to the sheet conveying mechanism 16 while being guided by sheet guides 13*a*, 13*b* and nipped by rollers of a feed roller pair 14.

The sheet conveying mechanism 16 includes: two belt rollers 6, 7; an endless sheet conveyor belt 8 wound around the two rollers 6, 7 so as to be stretched therebetween; a tension roller 10 which is in contact with the inner circumferential surface of the sheet conveyor belt 8 at the lower half portion of the loop of the sheet conveyor belt 8 while being biased downwardly, thereby applying tension to the sheet conveyor belt 8; and a platen 18 which is disposed in a region enclosed by the sheet conveyor belt 8. The platen 18 supports, at a position where the platen 18 is opposed to the ink-jet heads 1, the sheet conveyor belt 8 so as to prevent the sheet conveyor belt 8 from sagging downward. The belt roller 7 is a drive roller configured to be rotated clockwise in FIG. 1 by a drive force given to its shaft from a sheet delivery motor 19. The belt roller 6 is a driven roller configured to be rotated clockwise in FIG. 1 by the movement of the sheet conveyor belt 8 in accordance with rotation of the belt roller 7. The drive force of the sheet delivery motor 19 is transmitted to the belt roller 7 through a plurality of gears.

The outer circumferential surface 8*a* of the sheet conveyor belt 8 is silicone-treated so as to have adhesion property. A nip roller 4 is disposed at a position on the sheet delivery path at which the nip roller 4 faces the belt roller 6 with the sheet conveyor belt 8 interposed therebetween. The nip roller 4 is configured to press the sheet P supplied from the sheet-supply unit 101*b* onto the outer circumferential surface 8*a* of the sheet conveyor belt 8. The sheet P pressed onto the outer circumferential surface 8*a* of the sheet conveyor belt 8 is conveyed in a sheet conveyance direction, namely, in a sub scanning direction (in the rightward direction in FIG. 1), while being held on the outer circumferential surface 8*s* of the sheet conveyor belt 8 owing to its adhesion property.

A separation plate 5 is disposed at a position on the sheet delivery path where the separation plate 5 faces the belt roller 7. The separation plate 5 separates the sheet P held on the outer circumferential surface 8*a* of the sheet conveyor belt 8 therefrom. The separated sheet P is delivered upward while being guided by sheet guides 29*a*, 29*b* and nipped by rollers of each of two feed roller pairs 28. Subsequently, the sheep P is ejected from an outlet 30 formed at the upper portion of the casing 101*a* to the sheet receiving recessed portion 15 formed on the upper surface of the casing 101*a*.

The four ink-jet heads 1 respectively eject inks of the mutually different colors, i.e., magenta, yellow, cyan, and black. Each ink-jet head 1 has a generally rectangular parallelepiped shape having a longer dimension in a main scanning direction that is perpendicular to the sub scanning direction. The dimension of each head 1 as measured in the main scanning direction is larger than the width of the sheet. The four ink-jet heads 1 are arranged side by side in the sheet conveyance direction and immovable in the main scanning direction. That is, the ink-jet printer 101 is a printer of a line type.

The bottom surface of each ink-jet head 1 is made as an ejection surface 2*a* in which are formed a plurality of ejection holes 108 (FIG. 9) through which the ink is ejected. When the sheet P being conveyed passes right below the four ink-jet heads 1, the inks of the different colors are ejected from the ejection holes 108 toward the upper surface of the sheet P, whereby an intended color image is formed on the upper surface, i.e., on the print surface, of the sheet P.

The four ink-jet heads 1 are connected respectively to four ink tanks 17 disposed in the ink tank unit 101*c*. The inks of the mutually different four colors are stored in the respective four ink tanks 17. The inks are supplied from the ink tanks 17 to the respective ink-jet heads 1 via respective tubes.

Figure 2:
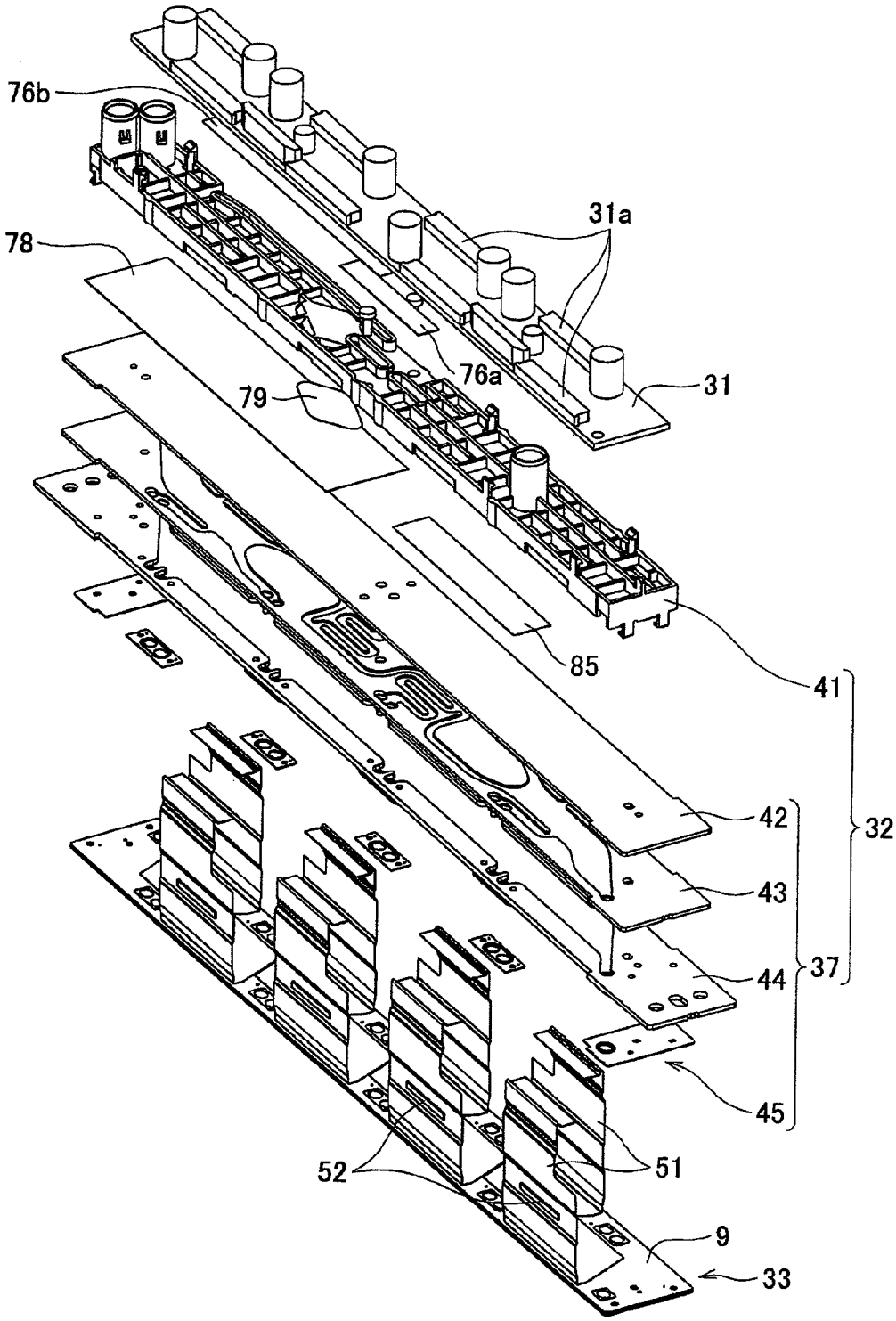
FIG. 2 is an exploded perspective view of the ink-jet head of FIG. 1.
Figure 3:
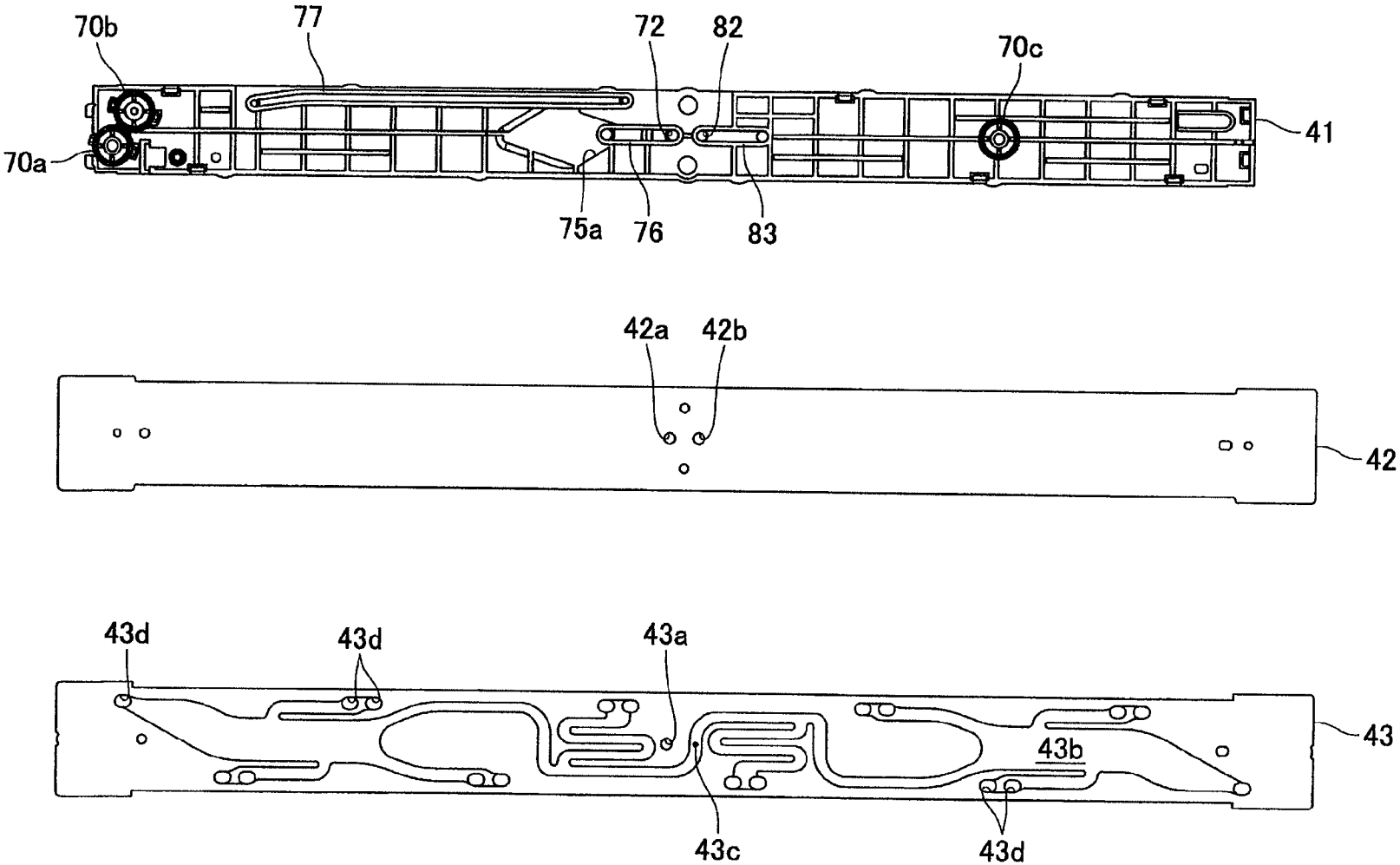
FIG. 3 is a plan view of a part of a plurality of plates constituting the ink-jet head of FIG. 1.
Figure 4:
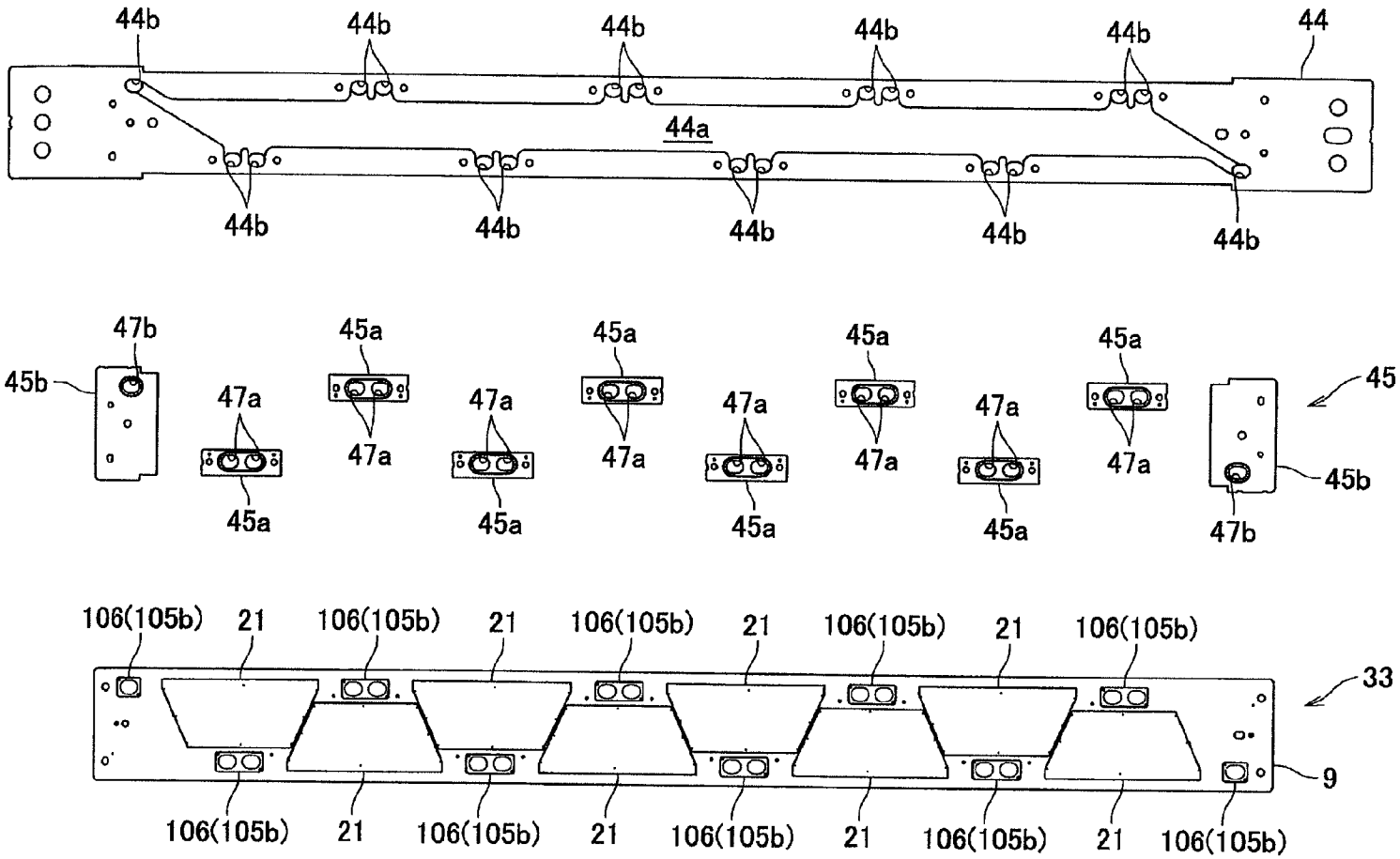
FIG. 4 is a plan view of a part of the plurality of plates constituting the ink-jet head of FIG. 1.

FIG. 2 is an exploded perspective view of the ink-jet head 1. As shown in FIG. 2, the ink-jet head 1 includes: a base plate 31; a reservoir unit 32 as a first flow-passage member; and a head main body 33 that includes a flow-passage unit 9 as a second flow-passage member. As shown in FIGS. 2-4, the reservoir unit 32 is constituted by: a laminar body 37 including three plates 42-44 and a small-plate group 45; and a filter support member 41 that is fixed to the upper surface of the laminar body 37. The small-plate group 45 consists of eight inner small plates 45*a* and two outer small plates 45*b*.

Referring to the cross sectional view of FIG. 5, the filter support member 41 will be explained. The filter support member 41 to which the ink is supplied from the ink tank 17 is formed by integral molding of a resin material. Three cylindrical projections 70*a*, 70*b*, 70*c* project upward from an upper surface 70*f* of the filter support member 41. A supply inlet 71 is formed in the cylindrical projection 70*a*. To the cylindrical projection 70*a*, a flexible tube is attached, and the ink in the ink tank 17 as an ink supply source is introduced into the filter support member 41 from the supply inlet 71 via the tube. A pump (not shown) for pressure purging is attached to the tube.

There is formed, in the filter support member 41, an ink flow passage 73 as an upstream region of a liquid-supply passage. The ink flow passage 73 includes: the supply inlet 71 in which an ink inlet opening is formed and which vertically extends; and a supply outlet 72 in which an ink outlet opening is formed and which vertically extends. The ink flow passage 73 includes an intermediate portion 93 between the supply inlet 71 and the supply outlet 72. In the intermediate portion 93, there is formed an elongate, rectangular opening 74*a* opening downward.

To the filter support member 41, there is attached a filter 79 as a first filter in which a plurality of minute through-holes are formed for filtering the ink. The filter 79 divides the intermediate portion 93 into: a first space 74 which is held in communication with the supply inlet 71 and which is defined by the rectangular opening 74*a*; and a second space 75 which is held in communication with the supply outlet 72. A region of the second space 75 which does not face the filter 79, i.e., a non-facing region 76, horizontally extends at a height level that is slightly higher than a height level of a region of the second space 75 which faces the filter 79. The supply outlet 72 extends from the non-facing region 76 in the vertically downward direction so as to open to a lower surface 70*e* of the filter support member 41.

The first space 74 has an elongate, rectangular shape. The opening 74*a* is sealed by a damper film 78 as a seal member. The damper film 78 has generally the same shape as the opening 74*a* in plan view. Thus, the damper film 78 cooperates with the filter support member 41 to define the ink flow passage 73. A peripheral wall 74*b* that defines the opening 74*a* extends downward to a predetermined height level throughout its periphery, so that the damper film 78 fixed to the lower end of the peripheral wall 74*b* extends horizontally.

In the second space 75, a downward opening 75*a* is defined by a recess. The opening 75*a* faces a part of the damper film 78 that extends from a position on a right side of the center of the damper film 78 to the right-side end of the same 78. The opening 75*a* has a shape, in plan view, that tapers in both of a direction of the ink flow and a direction opposite to the ink flow direction. The filter 79 has a shape substantially similar to that of the opening 75*a* and has a size in plan view somewhat larger than the opening 75*a*. The filter 79 is fixed in the first space 74 so as to cover the opening 75*a*. In other words, the filter 79 is fixed to the filter support member 41 so as to be opposed to the opening 74*a* and the damper film 78.

Figure 5:
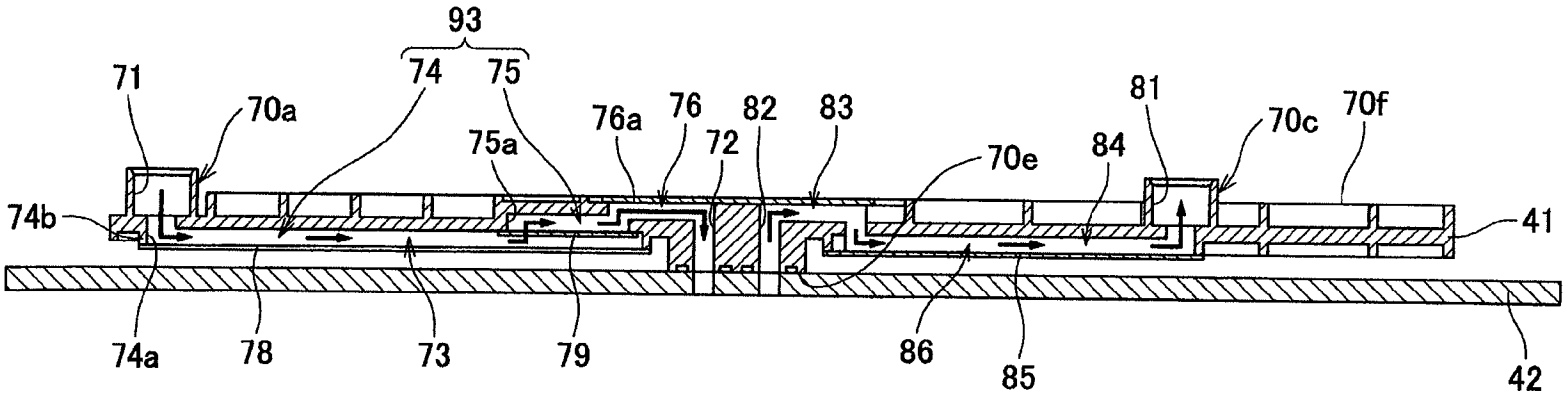
FIG. 5 is a cross sectional view of a filter support member included in the ink-jet head.

The ink introduced from the supply inlet 71 initially flows substantially horizontally in the first space 74 from the left to the right in FIG. 5, then reaches the region of the first space facing the filter 79, and flows upward through the filter 79. Subsequently, the ink flows into the second space 75 through the filter 79. In this occasion, foreign substances present in the ink flowed from the first space 74 are caught by the filter 79, and the ink from which the foreign substances have been removed by the filter 79 flows in the second space 75. After the ink has flowed in the non-facing region 76 of the second space 75, the ink flows downward through the supply outlet 72 and is finally discharged into the plate 42.

The damper film 78 is a flexible resin film. Between the damper film 78 and the upper surface of the plate 42, there is formed a clearance that allows deflection of the damper film 78 in accordance with vibration of the ink. According to the structure described above, the damper film 78 is deflected in the substantially vertical direction in accordance with the vibration of the ink, whereby the vibration of the ink can be absorbed and damped.

An opening is formed in the upper surface 70*f* of the filter support member 41 to define the non-facing region 76. The opening is sealed by a film 76*a* having flexibility, and the film 76*a* is deflected in accordance with the vibration of the ink, whereby the vibration of the ink is absorbed and damped. An opening formed in second discharge passages that will be explained below is also covered also by the film 76*a*.

In the filter support member 41, there is further formed a first discharge passage connecting the first space 74 and an outlet opening of the cylindrical projection 70*b*. The first discharge passage initially extends below the non-facing region 76 in the width direction of the filter support member 41, then extends in the longitudinal direction of the filter support member 41 after having extended upward to the same height level as the non-facing region 76, and finally communicates with the cylindrical projection 70*b* on the downstream side of a position at which the first discharge passage comes down to a height level lower than the filter 79. A region 77 having the same height level as the non-facing region 76 is defined by sealing an opening formed in the upper surface 70*f* of the filter support member 41 with a film 76*b*. The first discharge passage is utilized for discharging air bubbles staying in a portion of the filter support member 41 located on the upstream side of the filter 79.

In the filter support member 41, there is further formed an ink flow passage 86 as a downstream region of each of the second discharge passages which has an outlet at the tip of the cylindrical projection 70*c*. The ink flow passage 86 is a flow passage extending between a discharge inlet 82 that extends vertically upward from the lower surface 70*e* of the filter support member 41 and a discharge outlet 81 formed in the cylindrical projection 70*c*. The discharge inlet 82 is connected to a through-hole 42*b* of the plate 42 as described below.

The ink flow passage 86 initially extends from the upper end of the discharge inlet 82, subsequently extends, in the longitudinal direction of the filter support member 41, through an upper region 83 having the same height level as the non-facing region 76, then extends, in the longitudinal direction of the filter support member 41, through a lower region 84 that is located at a height level close to that of the lower surface 70*e* of the filter support member 41, and finally extends upward from the end of the lower region 84 so as to be held in communication with the discharge outlet 81 formed in the cylindrical projection 70*c*. The upper region 83 is defined by sealing the upward opening formed in the upper surface 70*f* of the filter support member 41 by the film 76*a*. The lower region 84 is defined by sealing a downward opening formed in the lower surface 70*e* of the filter support member 41 by a horizontally extending damper film 85 as a seal member. The second discharge passages are utilized to discharge air bubbles staying in a portion of the ink-jet head 1 that is located downstream of the filter 79 and upstream of connecting points that will be explained.

Each of the plates of the laminar body 37, i.e., the plates 42-44 and the small-plate group 45, is formed of a metal material having a higher degree of heat conductivity than the resin material of the filter support member 41. In the plates of the laminar body 37, there are formed through-holes and recesses which provide the downstream region of the liquid-supply passage, two branch passages (including eighteen outflow passages), and upstream regions of the respective second discharge passages as described below in detail.

More specifically, two through-holes 42*a*, 42*b* are formed through the thickness of the plate 42 in the vicinity of the central portion of the same 42, such that the through-hole 42*a* is opposed to the supply outlet 72 formed in the filter support member 41 and the through-hole 42*b* is opposed to the discharge inlet 82 formed in the same 41. The through-hole 42*a* that is a part of the downstream region of the liquid-supply passage is connected to the supply inlet 72, namely, connected to the ink flow passage 73 while the through-hole 42*b* that is a part of the upstream region of each of the second discharge passages is connected to the discharge inlet 82, namely, connected to the ink flow passage 86.

A through-hole 43*a* is formed through the thickness of the plate 43 so as to be opposed to the through-hole 42*a* of the plate 42. The through-hole 43*a* is a part of the downstream region of the liquid-supply passage. Further, a recess 43*b* as a part of the upstream region of each of the second discharge passages is formed in the plate 43 such that the central portion of the recess 43*b* is opposed to the through-hole 42*b* of the plate 42 at the central portion of the plate 43. The recess 43*b* is branched into a plurality of narrow passages near respective eighteen through-holes 43*d* as will be explained below. The recess 43*b* is formed by etching a substantially upper half portion of the plate 43 in its thickness direction.

In addition to the through-hole 43*a* and the recess 43*b*, the eighteen through-holes 43*d* are formed through the thickness of the plate 43 so as to be located within the recess 43*b*. More specifically, the eighteen through-holes 43*d* each as a part of the upstream region of the corresponding second discharge passage are located so as to be contiguous to the periphery of the recess 43*b* and are arranged, along the longitudinal direction of the plate 43, in two rows each consisting of nine through-holes 43*d*. The nine through-holes 43*d* in each of the two rows are disposed such that eight through-holes 43*d* except for the outermost one of the through-holes 43*d* form four pairs. Each pair consists of two through-holes 43*d* that are located adjacent to each other. Further, the eighteen through-holes 43*d* are disposed so as to have point symmetry with respect to the center (the central portion 43*c*) of the plate 43.

An elongate recess 44*a* is formed in the plate 44 so as to extend from one of longitudinal end portions of the plate 44 to the other of the longitudinal end portions of the same 44. The central portion of the recess 44*a* is opposed to the through-hole 43*a* of the plate 43. The recess 44*a* is formed by etching a substantially upper half portion of the plate 44 in its thickness direction. As will be explained, the recess 44*a* provides upstream regions of the respective two branched passages.

In addition to the recess 44*a*, eighteen through-holes 44*b* are formed through the thickness of the plate 44 in the vertical direction so as to be located within the recess 44*a*. Each through-hole 44*b* has a linear or straight shape that extends in a direction in which the ink flows into a corresponding filter 106 as a second filter (FIG. 6) that will be explained. The eighteen through-holes 44*b* are located so as to be contiguous to the periphery of the recess 44*a* and are arranged, along the longitudinal direction of the plate 44, in two rows each consisting of nine through-holes 44*b*. Each through-hole 44*b* is opposed to a corresponding one of the through-holes 43*d* of the plate 43.

In each of eight inner small plates 45*a* in the small-plate group 45, there are formed two through-holes 47*a* which are to be opposed to corresponding two adjacent through-holes 44*b* of the plate 44. In each of two outer small plates 45*b* between which the eight inner small plates 45*a* are disposed, one through-hole 47*b* is formed so as to be opposed to a corresponding one of the outermost through-holes 44*b* of the plate 44. Each of the through-holes 47*a*, 47*b* has the same diameter as the through-holes 44*b*.

In the present embodiment, the ink flow passage 73 formed in the filter support member 41 and the through-hole 42*a* and the through-hole 43*a* respectively formed in the plates 42 and the plate 43 are held in communication with each other so as to constitute the liquid-supply passage. The recess 44*a* formed in the plate 44 constitutes the upstream regions of the respective two branched passages. Further, the through-holes 44*b* formed in the plate 44 and the through-holes 47*a*, 47*b* formed in the small-plate group 45 are held in communication with each other to constitute the outflow passages. More specifically, each outflow passage is constituted by a combination of the through-hole 44*b* formed in the plate 44 and the through-hole 47*a* formed in a corresponding inner small plate 45*a* or the through-hole 47*b* formed in a corresponding outer small plate 45*b*. Each outflow passage is connected to a corresponding manifold 105 in the flow-passage unit 9 via a corresponding ink supply hole 105*b* that will be described.

Further, the through-holes 43*d* and the recess 43*b* formed in the plate 43, the through-hole 42*b* formed in the plate 42, and the ink flow passage 86 formed in the filter support member 41 are held in communication with each other so as to constitute the eighteen branched second discharge passages (as a plurality of discharge passages). The second discharge passages take the form of eighteen narrow passages at the level of the through-holes 43*d*. The eighteen narrow passages gradually decrease in number toward the central portion 43*c* of the plate 43, and finally merge with each other into one at the central portion 43*c* as a merge point. As a discharge port of the second discharge passages, only the above-described outlet formed at the tip of the cylindrical projection 70*c* exists in the reservoir unit 32. Because the only one discharge port of the second discharge passages exists, it is possible to simplify the connecting structure with respect to the reservoir unit 32. To the discharge port, one end of a tube (not shown) is connected, whereby the discharge port is connected to an atmosphere release opening provided at the other end of the tube, via an open/close valve attached to the tube.

As shown in FIG. 4, the head main body 33 includes the flow-passage unit 9, ten filters 106, and eight actuator units 21. The filters 106 and the actuator units 21 are fixed to the upper surface of the flow-passage unit 9. Each filter 106 is provided for a corresponding one of the ten small plates 45*a*, 45*b*, and covers one or two ink supply holes 105*b*.

Figure 9:
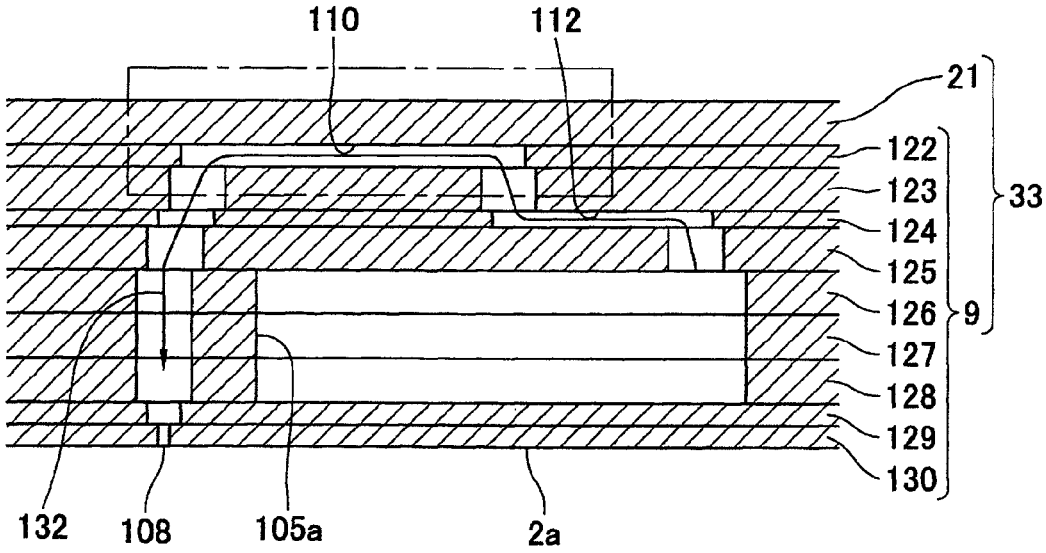
FIG. 9 is a cross sectional view taken along line IX-IX in FIG. 8.

Each of the eight actuator units 21 includes a plurality of piezoelectric actuators for giving ejection energy to the ink in respective pressure chambers 110 (FIG. 9). A COF 51 which is a flat flexible substrate is bonded to the upper surface of each actuator unit 21, as shown in FIG. 2. On each COF 51, a driver IC 52 for generating drive signals to be supplied to the corresponding actuator unit 21 is mounted. The filter support member 41, the laminar body 37, and the flow-passage unit 9 are stacked on one another in a direction in which the ink flows from the eighteen outflow passages to the manifolds 105, so as to provide a laminated structure.

A plurality of electronic components are disposed on the base plate 31 of the head 1. The COFs 51 are connected to the electronic components via connectors 31*a* attached to the base plate 31. The electronic components disposed on the base plate 31 are connected to the control portion 100 via wires not shown.

Figure 6:
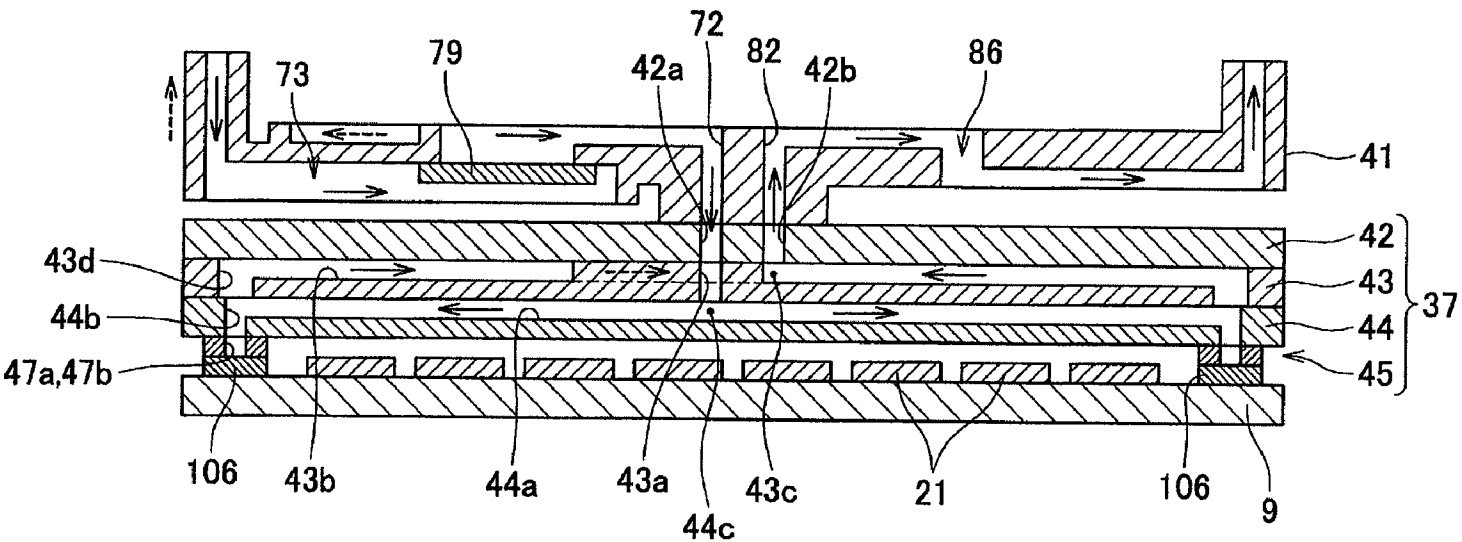
FIG. 6 is a schematic cross sectional view of the ink-jet head in its longitudinal direction.

FIG. 6 is a schematic cross sectional view of the head 1 in its longitudinal direction, in which the base plate 31 is not illustrated. In FIG. 6, the aspect ratio of each component is largely changed in order that passages can be easily visible. As shown in FIG. 6, the ink that has flowed from the ink flow passage 73 down to the recess 44*a* via the through-holes 42*a*, 43*a* flows in the recess 44*a* in mutually opposite directions toward the respective longitudinal or outer end portions of the plate 44. That is, two portions of the recess 44*a* that extend from a central portion 44*c* of the recess 44*a* toward the respective longitudinal ends of the plate 44, namely, a right half portion of the recess 44*a* and a left half portion of recess 44*a* as seen in FIG. 6, function as the two branched passages which are branched from the liquid-supply passage.

The ink that has flowed in the recess 44*a* in the mutually opposite directions flows into the flow-passage unit 9 via the eighteen outflow passages formed of the through-holes 44*b* of the plate 44 and the through-holes 47*a*, 47*b* of the plate 45.

In the present embodiment, the second discharge passages are connected to the branched passages at respective connecting points (at the upper ends of the respective through-holes 44*b*) which are located downstream of the filter 79 and downstream of the central portion 44*c* of the recess 44*a* at which the liquid-supply passage is branched into the two branched passages. Accordingly, a substantial part of the air bubbles staying in the head 1 can be effectively discharged through the second discharge passages in the pressure purging operation.

In the present embodiment, nine outflow passages (through-holes 44*b*, 47*a*, 47*b*) are formed in each of the two branched passages. In other words, in the present embodiment, a plurality of outflow passages are divided into a plurality of groups so as to correspond to the plurality of branch passages, and a part of the plurality of outflow passages that belongs to each of the plurality of groups forms portions of a corresponding one of the plurality of branch passages. Each of the two branched passages is connected at the nine outflow passages to corresponding manifolds 105 each as a common liquid passage formed in the flow-passage unit 9. Further, each filter 106 is disposed between the corresponding through-holes 47*a* or through-hole 47*b* and the corresponding manifold 105. Moreover, the second discharge passages are formed so as to correspond to the respective outflow passages. According to the arrangement, the air bubbles staying in the reservoir unit 32, especially in the laminar body 37, can be effectively discharged.

Each outflow passage has a linear or straight shape extending in the direction in which the ink flows into a corresponding one of the filters 106. In other words, each outflow passage linearly extends in a direction parallel to the direction in which the ink flows into the filter 160. Each of the second discharge passages is connected to the upper or upstream end of a corresponding one of the outflow passages having the linear or straight shape and has a linear region (the through-hole 43*d*) that extends from a connecting point with the corresponding outflow passage in a direction opposite to a direction in which the corresponding outflow passage extends. In the present embodiment, the connecting point of each second discharge passage with the corresponding outflow passage coincides with the above-indicated connecting point of each second discharge passage with the corresponding branch passage. According to the arrangement, one outflow passage composed of the through-holes 44*b*, 47*a* or 47*b*, and the linear region (the through-hole 43*d*) of one second discharge passage that corresponds to that one outflow passage are arranged in a straight line, whereby the air bubbles staying in the reservoir unit 32, especially in the laminar body 37, can be effectively discharged.

Figure 7:
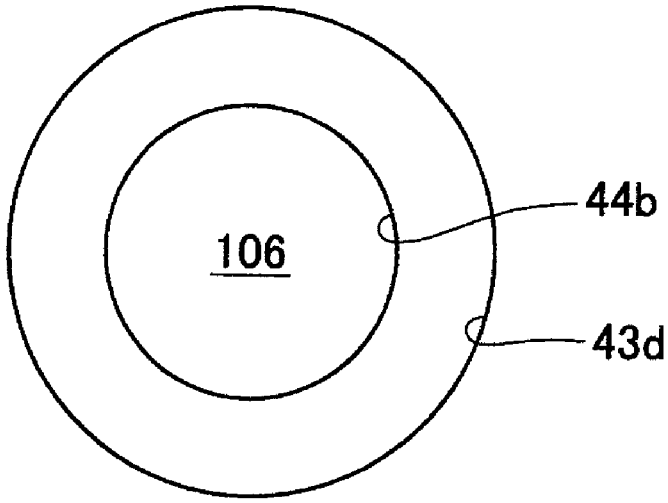
FIG. 7 is a plan view showing a relationship among a second discharge passage, an outflow passage, and a filter.

In the present embodiment, the through-hole 43*d* as the linear region of each second discharge passage is formed as a first penetrating passage that penetrates through the plate 43. Further, each outflow passage of the branch passages is formed as a second penetrating passage that penetrates through the plates 44 and the plate 45*a* or 45*b*. As shown in FIG. 7, the size (the diameter) of the first penetrating passage (the through-hole 43*d*) is larger than that of the second penetrating passage (the through-holes 44*b*, 47*a*, 47*b*). Further, the second penetrating passage is located within the first penetrating passage when viewed in a direction of lamination of the plates of the reservoir unit 32, and the filter 106 is attached to the plate 45*a* or 45*b* such that the filter 106 is exposed to the bottom of the second penetrating passage, namely, the filter 106 is disposed at one end of the second penetrating passage. Accordingly, the air bubbles staying on the filter 106 can easily flow upward to the corresponding second discharge passage.

As explained above, the reservoir unit 32 has a laminated structure including the plates 41-44 and the small-plate group 45. Respective regions of the eighteen second discharge passages except: the downstream regions thereof located on the downstream side of the central portion 43*c* of the plate 43 (i.e., the merge point); and the linear regions thereof (the through-holes 43*d*) are provided by the recess 43*b* formed in the plate 43. In other words, a region of each of the second discharged passages except: its downstream region located on the downstream side of the central portion 43*c* of the plate 43 (i.e., the merge point); and its linear region (the through-hole 43*d*) is defined within the thickness of the plate 43. In the present embodiment, the downstream regions of the respective eighteen second discharge passages are common to each other. Respective regions of the two branch passages except regions thereof corresponding to the outflow passages (the through-holes 44*b*, 47*a*, 47*b*) are provided by the recess 44*a* formed in the plate 44. In other words, a region of each branch passage except regions thereof corresponding to the outflow passages formed therein is defined within the thickness of the plate 44. According to the arrangement, the second discharge passages and the branch passages are provided by a simple structure with a relatively small number of the plates.

As apparent from FIGS. 3 and 4, a region of each of the eighteen second discharge passages except its linear region (the through-hole 43*d*) and a region of each of the two branch passages except regions thereof corresponding to the outflow passages formed therein at least partially overlap each other when viewed in the direction of lamination of the plates of the reservoir unit 32. The arrangement reduces the area of the head 1 when viewed from the top.

The eighteen second discharge passages are disposed so as to have point symmetry with respect to the central portion 43*c* of the plate 43 as the merge point, in the plane perpendicular to the ink flow direction into the filters 106. In other words, the second discharge passages are disposed so as to have point symmetry with respect to the central portion 43*c* of the plate 43 when viewed in the direction parallel to the ink flow direction into the filters 106. The arrangement reduces a difference among the amounts of the air bubbles to be discharged through the respective second discharge passages.

In the present embodiment, the eighteen second discharge passages have mutually the same resistance against a flow of the ink flowing therethrough from the connecting portions located at the upstream ends of the through-holes 44*b* to the outlet at the tip of the cylindrical projection 70*c*. The arrangement reduces a difference among the amounts of the air bubbles to be discharged through the respective second discharge passages.

Figure 8:
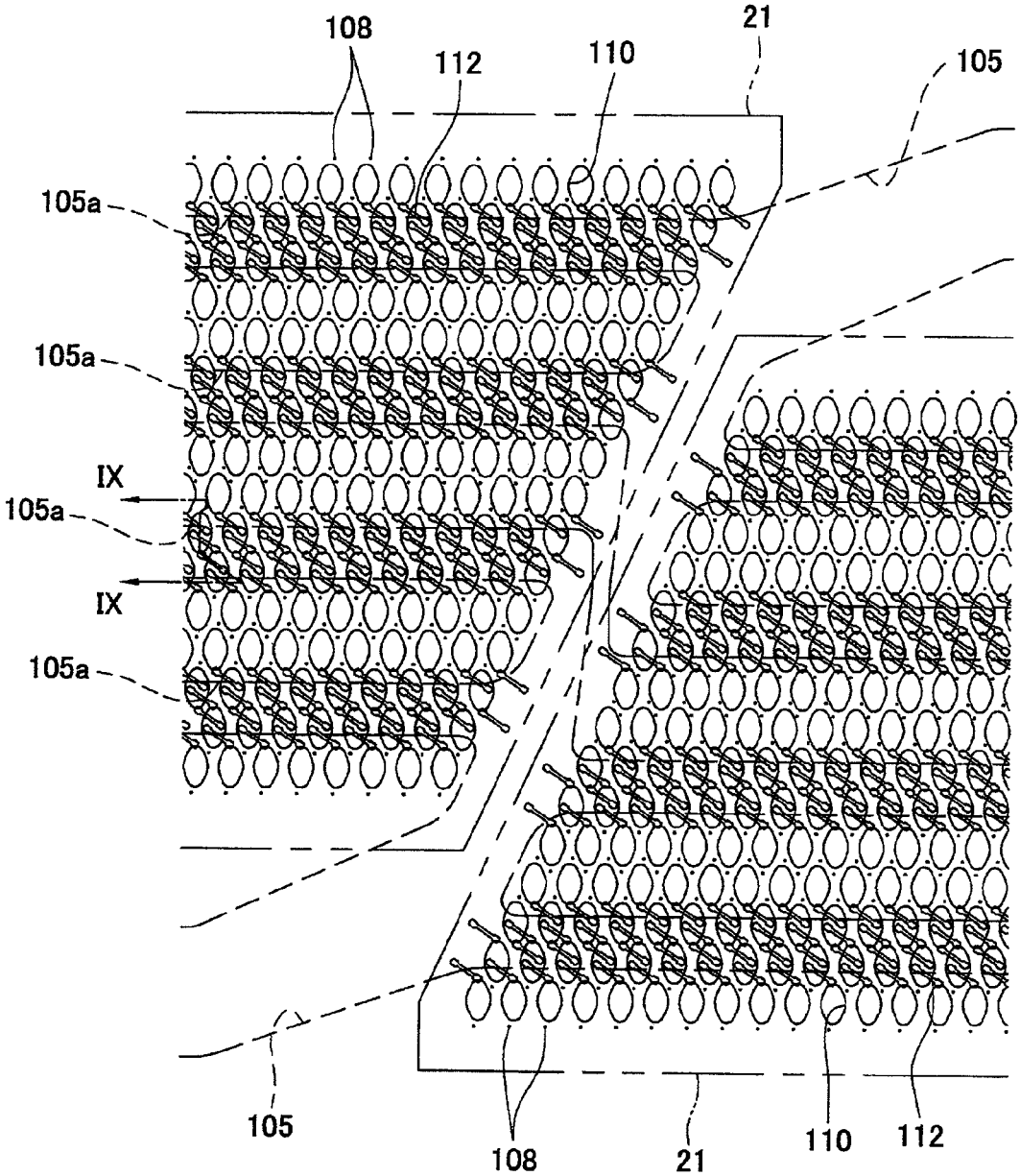
FIG. 8 is an enlarged plan view of a part of a flow-passage unit included in the ink-jet head.
Figure 10A:
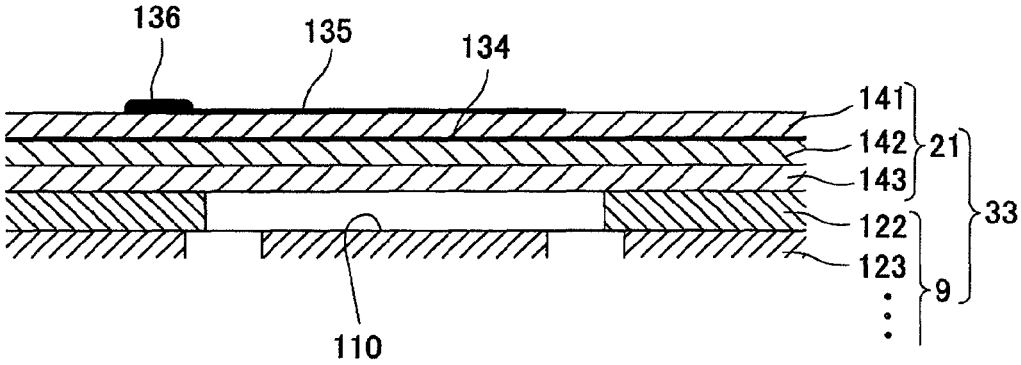
FIG. 10A is an enlarged cross sectional view of the actuator unit and FIG. 10B is a plan view of an individual electrode.
Figure 10B:
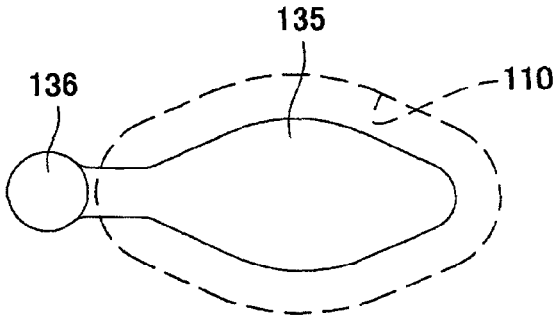

Referring next to FIGS. 8, 9, 10A, and 10B, the head main body 33 will be explained in detail. FIG. 8 is a plan view showing a part of two adjacent actuator units 21. FIG. 9 is a partial cross sectional view of the flow-passage unit 9 along line IX-IX in FIG. 8. FIG. 10A is an enlarged cross sectional view of an area enclosed by the dashed line in FIG. 9 and FIG. 10B is a plan view of an individual electrode. In FIG. 8, apertures 112 that should be indicated by a broken line are indicated by a solid line for easier understanding.

As shown in FIG. 8, a plurality of pressure chambers 110 each having a generally rhombic shape are regularly disposed in a matrix on the upper surface of the flow-passage unit 9. Each actuator unit 21 includes a plurality of individual electrodes 135 (FIG. 10A) disposed so as to be respectively opposed to the plurality of pressure chambers 110 formed in the flow-passage unit 9. The actuator unit 21 has a function of selectively giving ejection energy to the ink in the pressure chambers 110.

The ink supply holes 105*b* (FIG. 4) are open to the upper surface of the flow-passage unit 9 so as to respectively correspond to the eighteen outflow passages of the reservoir unit 32. The ink supply holes 105*b* are covered with the corresponding filters 106 each having a smaller mesh size than the filter 79. The foreign substances existing in the ink that has passed through the outflow passages are caught by the filters 106, and the ink from which the foreign substances have been removed flows into the flow-passage unit 9. In the flow-passage unit 9, there are formed: a plurality of manifolds 105 each extending from a corresponding one of the ink supply holes 105*b*; and a plurality of sub manifolds 105*a*, each as a common liquid passage, which are branched from corresponding manifolds 105. On the lower surface of the flow-passage unit 9, the ejection surfaces 2*a* are arranged in each of which a plurality of ejection holes 108, each as a nozzle opening, are regularly arranged in matrix.

As shown in FIG. 9, the flow-passage unit 9 is constituted by nine metal plates including a cavity plate 122, a base plate 123, an aperture plate 124, a supply plate 125, three manifold plates 126, 127, 128, a cover plate 129, and a nozzle plate 130, which are arranged in this order from the top of the flow-passage unit 9. Each of the nine plates 122-130 has a rectangular shape in plan view which is long in the main scanning direction.

The nine plates 122-130 are positioned with and stacked on each other, whereby a plurality of individual ink passages 132 as a plurality of individual liquid passages are defined in the flow-passage unit 9 each of which extends from an outlet of a corresponding one of the sub manifolds 105*a* to a corresponding one of the ejection holes 108 via a corresponding one of the pressure chambers 110. The ink which has supplied from the reservoir unit 32 to the flow-passage unit 9 via the ink supply holes 105*b* flows into the sub manifolds 105*a* from the manifolds 105. The ink in the sub manifolds 105*a* flows into the individual ink passages 132 and reaches nozzle ejection holes 108 via the apertures 112 each functioning as an orifice and the pressure chambers 110.

The actuator unit 21 will be explained. As shown in FIG. 4, the eight actuator units 21 each having a trapezoidal shape in plan view are arranged in a zigzag fashion in the longitudinal direction of the flow-passage unit 9 so as to avoid the ink supply holes 105*b*. Parallel facing sides (short and long sides) of each actuator unit 21 are parallel to the longitudinal direction of the flow-passage unit 9, and oblique sides of neighboring two actuator units 21 partially overlap as viewed in the longitudinal direction of the flow-passage unit 9, namely, in the main scanning direction, as shown in FIG. 8.

As shown in FIG. 10A, each actuator unit 21 includes three piezoelectric layers 141-143 formed of a ceramic material of lead zirconate titanate (PZT) having ferroelectricity. The individual electrodes 135 are formed on respective regions of the uppermost piezoelectric layer 141 that correspond to the pressure chambers 110. A common electrode 134 is provided on an interface between the uppermost piezoelectric layer 141 and the piezoelectric layer 142 located under the layer 141. As shown in FIG. 10B, each individual electrode 135 has a generally rhombic shape in plan view similar to the pressure chamber 110. One acute end portion of the individual electrode 135 extends beyond the pressure chamber 110, and a circular land 136 is formed at the acute end portion for electrical connection with the individual electrode 135. In addition to the lands 136 for the individual electrodes 135, a land for the common electrode 134 is formed on the upper surface of the piezoelectric layer 141. The land for the common electrode 134 is connected to the common electrode 134 via the conductive material in through-holes.

The common electrode 134 is kept at a ground potential as a basic potential given by the COF 51. The individual electrodes 135 are electrically connected to terminals of the driver IC 52 via the respective lands 136 and respective internal wires of the COF 51. A drive signal for driving the actuator unit 21 is supplied from the driver IC 52 to the individual electrodes 135 independently of each other. Accordingly, respective portions in the actuator unit 21 sandwiched by and between the individual electrodes 135 and the pressure chambers 110 function as individual actuators which are independent of each other. That is, a plurality of actuators, each as an energy giving member, are provided in the actuator unit 21 in the same number as the pressure chambers 110.

There will be next explained a method of driving each actuator unit 21 to permit ink droplets to be ejected from the nozzles. The piezoelectric layer 141 is polarized in its thickness direction. When an electric field is applied to the piezoelectric layer 141 in the polarization direction with one individual electrode 135 kept at a potential different from that of the common electrode 134, a portion of the piezoelectric layer 141 to which the electric field is applied functions as an active portion that undergoes strain owing to a piezoelectric effect. The active portion expands in a direction of thickness of the layer 141 and contracts in a direction parallel to the plane of the layer 141 (i.e., in the plane direction) when the electric field and the polarization are in the same direction. In this instance, the amount of deformation of the active portion upon expansion and contraction is larger in the plane direction than in the thickness direction. In the actuator unit 21, the uppermost one 141 of the three piezoelectric layers that is the most distant from the pressure chambers 110 is an active layer including the active portions while the lower two piezoelectric layers 142, 143 nearer to the pressure chambers 10 are non-active layers. As shown in FIG. 10A, the piezoelectric layer 143 is fixed to the upper surface of the cavity plate 122 that defines the pressure chambers 110. Accordingly, when there is generated a difference in strain in the plane direction between the portion of the piezoelectric layer 141 to which the electric field is applied and the piezoelectric layers 142, 143 located under the layer 141, the entirety of the piezoelectric layers 141-143 deforms into a convex shape that protrudes toward the pressure chamber 110 (unimorph deformation). Accordingly, the pressure (ejection energy) is given to the ink in the pressure chamber 110, so that there is generated a pressure wave in the pressure chamber 110. The generated pressure chamber propagates from the pressure chamber 110 to the ejection hole 108 of the corresponding nozzle, whereby the ink droplets are ejected from the ejection hole 108.

Unlike the discharge passage of the ink-jet head disclosed in the above-indicated Patent Document 1, the second discharge passages in the ink-jet head 1 according to the illustrated embodiment are connected to the branch passages at the respective connecting points (at the upper ends of the respective through-holes 44*b*) which are located downstream of the filter 79 and downstream of the central portion 44*c* of the recess 44*a* at which the liquid-supply passage is branched into the two branch passages. Accordingly, a substantial part of the air bubbles staying in the head 1 can be effectively discharged through the second discharge passages in the pressure purging operation. On this occasion, there is not disposed, in the second discharge passages, any component that causes a large pressure loss such as a filter whose mesh size is smaller than that of the filter 79, it is possible to reduce the pressure loss generated upon discharging of the air bubbles through the second discharge passages. Accordingly, the air bubbles can be sufficiently discharged simply by conducting the purging operation in which the output level of the pump is set at a normal level. Hence, the amount of ink to be discarded by the purging operation does not increase, thereby obviating a disadvantage to the user. Further, the air bubbles can be effectively discharged through the second discharge passages, thereby reducing occurrence of deterioration in the printing performance which would be otherwise caused due to gradual growth of the air bubbles. Accordingly, it is hardly required to replace the ink-jet heads 1.

It is to be understood that the invention is not limited to the details of the illustrated embodiment, but may be embodied with various changes and modifications, which may occur to those skilled in the art, without departing from the spirit and scope of the invention defined in the attached claims. In the illustrated embodiment, the eighteen second discharge passages are connected to the upstream ends of the respective through-holes 44*b*. Instead, two second discharge passages may be connected to the recess 44*a* on the opposite sides (the left side and the right side) of the central portion 44*c* of the recess 44*a*. While the second discharge passages are provided for the respective eighteen outflow passages in the illustrated embodiment, the second discharge passages may be provided for only a part of the eighteen outflow passages. In this instance, at least one second discharge passage may be provided for each of the nine outflow passages that are located on the left or right side of the central portion 44*c* of the recess 44.

In the illustrated embodiment, the eighteen second discharge passages merge with each other to become one passage for which only one discharge port is provided. The discharge port may be provided for each of the eighteen second discharge passages. Alternatively, the eighteen second discharge passages may merge with each other such that two or more discharge ports are provided. In the illustrated embodiment, one recess is utilized as a part of each of the second discharge passages or as a part of each of the branch passages. Each second discharge passage or each branch passage may be constituted by only a through-hole without using the recess.

In the illustrated embodiment, the linear region of each second discharge passage is formed by only the through-hole 43*d* formed in the single plate 43. The linear region may extend through two or more of the plates. While each outflow passage in the illustrated embodiment has a structure in which the through-hole 44*b* of the plate 44 and the through-hole 47*a* or 47*b* of the small-plate group 45 are connected to each other, each outflow passage may be formed by only a through-hole formed in one plate.

Only one common liquid passage may be formed in the flow-passage unit. The passage structure in the head is not limited to that in the illustrated embodiment, but may be otherwise modified. The energy giving member is not limited to the one utilizing the piezoelectric body, but the one of thermal type may be utilized.

It is to be understood that the principle of the invention may be applicable not only to the head for a line printer as in the illustrated embodiment, but also to a head for a serial printer, and further to a head for ejecting a liquid other than the ink.

What is claimed is:

1. A liquid ejecting head for ejecting a liquid from a plurality of ejection holes, comprising:

a first flow-passage member in which are formed (a) a liquid-supply passage to which the liquid is supplied from an exterior of the liquid ejecting head, (b) a plurality of branch passages connected to the liquid-supply passage, and (c) a plurality of discharge passages each of which is connected to any of the plurality of branch passages and each of which is in communication with an outside of the first flow-passage member;

a second flow-passage member in which are formed (a) at least one common liquid passage each of which is in communication with at least one of the plurality of branch passages and (b) a plurality of individual passages which are provided so as to respectively correspond to the plurality of ejection holes, each of which is connected to any one of the at least one common liquid passage, and which respectively have pressure chambers formed therein, each of the plurality of individual liquid passages introducing the liquid to a corresponding one of the plurality of ejection holes via a corresponding one of the pressure chambers;

a first filter disposed in the liquid-supply passage;

a plurality of second filters disposed between the plurality of branch passages and the at least one common liquid passage; and at least one energy giving member configured to give ejection energy to the liquid in each of the pressure chambers that are formed respectively in the plurality of individual liquid passages, wherein each of the plurality of discharge passages is connected to one of the plurality of branch passages at a downstream side of the first filter.

2. The liquid ejecting head according to claim 1, wherein a plurality of outflow passages are formed in the first flow-passage member, through each of which the liquid is introduced into any one of the at least one common liquid passage and which are divided into a plurality of groups so as to correspond to the plurality of branch passages, a part of the plurality of outflow passages that belongs to each of the plurality of groups forms portions of a corresponding one of the plurality of branch passages, and wherein each of the at least one common liquid passage is connected to at least one of the plurality of outflow passages.

3. The liquid ejecting head according to claim 2, wherein the plurality of second filters are disposed between the plurality of outflow passages and the at least one common liquid passage.

4. The liquid ejecting head according to claim 2, wherein each of the plurality of outflow passages linearly extends in a direction parallel to a direction in which the liquid flows into each of the plurality of second filters.

5. The liquid ejecting head according to claim 4, wherein the first flow-passage member has a laminar structure composed of a plurality of plates, and wherein each of the plurality of outflow passages is formed as a penetrating passage that penetrates through at least one of the plurality of plates.

6. The liquid ejecting head according to claim 2, wherein the plurality of discharge passages are formed so as to respectively correspond to the plurality of outflow passages.

7. The liquid ejecting head according to claim 6, wherein each of the plurality of discharge passages is connected to any one of the plurality of branch passages at a connecting point that is located at an upstream end of a corresponding one of the plurality of outflow passages.

8. The liquid ejecting head according to claim 7, wherein each of the plurality of outflow passages linearly extends in a direction parallel to a direction in which the liquid flows into each of the plurality of second filters.

9. The liquid ejecting head according to claim 8, wherein each of the plurality of discharge passages has a linear region that linearly extends from the connecting point in a direction opposite to the direction in which a corresponding one of the plurality of outflow passages extends.

10. The liquid ejecting head according to claim 9, wherein the first flow-passage member has a laminar structure composed of a plurality of plates, and wherein the linear region of each of the plurality of discharge passages is formed as a penetrating passage that penetrates through at least one of the plurality of plates.

11. The liquid ejecting head according to claim 1, wherein the plurality of discharge passages have mutually the same resistance against a flow of the liquid flowing therethrough.

12. The liquid ejecting head according to claim 1, wherein the plurality of discharge passages merge with each other at a merge point in the first flow-passage member, and one discharge port is formed in the first flow-passage member so as to allow each of the plurality of discharge passages to communicate with the exterior.

13. The liquid ejecting head according to claim 12, wherein the plurality of discharge passages are disposed so as to have point symmetry with respect to the merge point when viewed in a direction parallel to a direction in which the liquid flows into each of the plurality of second filters.

14. The liquid ejecting head according to claim 12, wherein a plurality of outflow passages are formed in the first flow-passage member, through each of which the liquid is introduced into any one of the at least one common liquid passage and which are divided into a plurality of groups so as to correspond to the plurality of branch passages, a part of the plurality of outflow passages that belongs to each of the plurality of groups forms portions of a corresponding one of the plurality of branch passages, wherein each of the at least one common liquid passage is connected to at least one of the plurality of outflow passages, wherein each of the plurality of outflow passages linearly extends in a direction parallel to a direction in which the liquid flows into each of the plurality of second filters, wherein the plurality of discharge passages are formed so as to respectively correspond to the plurality of outflow passages, wherein each of the plurality of discharge passages is connected to any one of the plurality of branch passages at a connecting point that is located at an upstream end of a corresponding one of the plurality of outflow passages and each of the plurality of discharge passages has a linear region that linearly extends from the connecting point in a direction opposite to the direction in which a corresponding one of the plurality of outflow passages extends, wherein the first flow-passage member has a laminar structure composed of a plurality of plates, wherein a region of each of the plurality of discharge passages except (a) a downstream region thereof that is located on a downstream side of the merge point and (b) the linear region thereof is defined within a thickness of one of the plurality of plates, and wherein a region of each of the plurality of branch passages except regions thereof corresponding to the part of the plurality of outflow passages that forms the portions of said each of the plurality of branch passages is defined within a thickness of another one of the plurality of plates that is different from the one of the plurality of plates.

15. The liquid ejecting head according to claim 14, wherein the linear region of each of the plurality of discharge passages is formed as a first penetrating passage that penetrates through at least one of the plurality of plates, and wherein each of the plurality of outflow passages is formed as a second penetrating passage that penetrates through at least another one of the plurality of plates that is different from the at least one of the plurality of plates.

16. The liquid ejecting head according to claim 15, wherein the first penetrating passage has a size larger than that of the second penetrating passage, and wherein the second penetrating passage is located within the first penetrating passage when viewed in a direction of lamination of the plurality of plates.

17. The liquid ejecting head according to claim 16, wherein each of the plurality of second filters is disposed at one end of a corresponding one of the second penetrating passage.

18. The liquid ejecting head according to claim 14, wherein a region of each of the plurality of discharge passages except the linear region thereof and a region of each of the plurality of branch passages except regions thereof corresponding to the part of the plurality of outflow passages that forms the portions of said each of the plurality of branch passages at least partially overlap when viewed in a direction of lamination of the plurality of plates.

19. The liquid ejecting head according to claim 1, wherein each of the plurality of discharge passages is connected to one of the plurality of branch passages at a connecting point positioned downstream from where the plurality of branch passages are connected to the liquid-supply passage.

* * * * *